US005373768A

United States Patent [19]

Sciortino

[11] Patent Number: 5,373,768

[45] Date of Patent: Dec. 20, 1994

[54] MUSICAL INSTRUMENT NECK ILLUMINATOR

[76] Inventor: Kevin Sciortino, 4510 NW. 41st Ter., Lauderdale Lakes, Fla. 33319

[21] Appl. No.: 51,079

[22] Filed: Apr. 21, 1993

[51] Int. Cl.[5] ..... G10D 3/00

[52] U.S. Cl. ..... 84/293; 84/314 R; 84/464 R; 84/DIG. 30; 362/32; 362/253

[58] Field of Search ..... 84/293, 464 A, 314 R, 84/464 R, 477 R; 362/32, 109, 253, 806

[56] References Cited

U.S. PATENT DOCUMENTS 3,943,815 3/1976 Gilbert ..... 84/293
4,422,719 12/1983 Orcutt ..... 362/32 X
4,726,641 2/1988 Mori ..... 362/32 X

*Primary Examiner*—Michael L. Gellner
*Assistant Examiner*—Patrick J. Stanzione
*Attorney, Agent, or Firm*—Malin, Haley, DiMaggio & Crosby

[57] ABSTRACT

An attachable and removable illuminated fiber optic strand adhered to the top side surface of a guitar neck and which conducts light to a plurality of predetermined proportionally etched abrasions exposed along the longitudinal length of the optically conductive fiber optic strand. The device provides multiple illuminated points of light along the top side surface of the guitar neck facing the guitarist, thereby allowing the instrument to be played in the dark and producing a pleasing visual effect.

1 Claim, 2 Drawing Sheets

MUSICAL INSTRUMENT NECK ILLUMINATOR

BACKGROUND OF THE INVENTION

1. Field of the Invention

This invention relates generally to musical instruments and, more particularly, to a guitar neck illuminator that is applied on the neck of the instrument, illuminating reference points which aids in playing in dark, or dim surroundings.

2. Description of the Prior Art

A method of maintaining a point of reference when playing any musical instrument is a much desired experience to any musician. Be it a pianist, with patterns of black and white keys along a keyboard, or a guitarist, having fret markers along a guitar neck.

Guitarists in the art of performing musical works, all share a common impeding factor of dark surroundings in many playing environments.

The inability to see where to be playing in the beginning stages of musicianship handicaps the progress of learning proper techniques that can later affect performance and concentration of execution.

The answer to limited visibility on a guitar neck in dark surroundings utilizes various methodologies advancing with the progression of technology, allowing more efficient and effective systems to be developed. U.S. Pat. No. 3,943,815 issued to Clifford W. Gilbert, discloses fiber optic strands extending through the neck, conducting light from a source located in the body, to illuminate fret markers on the top and fretted surfaces of the guitar neck. U.S. Pat. No. 3,324,755 issued to Lewis Leon Canenice, discloses a guitar having an illuminated neck made of transparent plastic. U.S. Pat. No. 3,854,370 issued to Stanley Saphenhi, discloses a finger board having light transmitting substrates received in a space between the neck and fingerboard.

All of the prior patents are for illuminating a guitar neck in one manner or another. Conversely, fiber optic strands routed through the neck of a guitar work effectively, but are costly and require irreversible physical alterations to the neck upon installation, also adding additional weight due to internal power source. In addition, a guitar neck made of transparent plastic conducts light well, but is very heavy in weight and very costly in price.

A system of light conductive substrates inserted into a slot located between the fretboard and the neck, also requires custom alterations that lead to structural implications. The main problem with prior systems that are utilized to illuminate guitar necks, are that most require irreversible, physical alterations to the original condition of the instrument upon installation. Such physical alterations to the guitar can greatly reduce its value as well as destroy the original beauty of the instrument. This limitation in the prior art is significant as many guitarist, amateur or professional, play guitars originally built in the 1950's and 1960's (i.e. 1959 Gibson Les Paul Sunburst). These guitars are considered classics and any physical alterations to such guitars would greatly reduce the value of the instrument. In addition, obstructions along the guitar neck must be minimal to allow the fretting hand to be comfortable when playing.

Thus, what is needed in the art is a low cost, lightweight guitar neck illuminator system that provides adequate distribution of light and a means of easy installation and removal without altering the original condition of the guitar neck, while providing minimal obstructive resistance along the guitar neck.

While the prior art sets forth various methodologies for illuminating a guitar neck, no prior art is known that provides, either separately or in combination, the teaching or suggestion, or incentive to make a low cost guitar neck illuminator that is lightweight and functional as a point of reference that is removable and minimally obstructive to the fretting hand.

SUMMARY OF THE INVENTION

The present invention is a guitar neck illuminator that addresses the above problems through the use of a unique fiber optic system. The illuminator is constructed of a transparent fiber optic strand which is installed by adhering it to the top surface of a guitar neck with transparent adhesive tape. Once installed, the instant invention provides a visually inconspicuous means for guitar neck illumination that is unnoticed from a distance when not illuminated due to its transparent design.

Proportionally etched abrasions are located along the longitudinal length of the fiber optic strand, lining up directly over and adjacent with the fret markers located on the top side surface of a guitar neck facing the guitarist when in use. There is one etched abrasion for each fret marker on the top side surface of the neck. The light source consists of a miniature light bulb which is enclosed within a thermally resistive sleeve that is electronically connected in series with an external power source of the portable battery type, located and attached inconspicuously behind the headstock of a guitar neck adhesively, by means of a battery holder clip. The light source within the sleeve is positioned and seated to abut one end of the fiber optic strand. Light emitted from the light source fiber optically conducts and is evenly distributed throughout the entire length of the fiber optic strand, causing the emitted light to refract within and disperse emittively off the locations of the proportionally etched abrasions, thus giving the effect of multiple illuminated guitar fret marker lights. This allows the guitarist to have a point of reference to where the frets are located on a guitar neck when playing in dark or dim surroundings and also enhances the aesthetic appeal of the guitar.

Thus, the object of the invention is to provide an inexpensive guitar neck illuminator that is low in cost and provides the advantages of easy installation and removal without altering the original condition of the instrument it is applied to.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

In accordance with these and other objects which will be apparent hereinafter, the instant invention will now become described with particular reference to the accompanying drawings.

DESCRIPTION OF THE PREFERRED EMBODIMENTS

Figure 1:
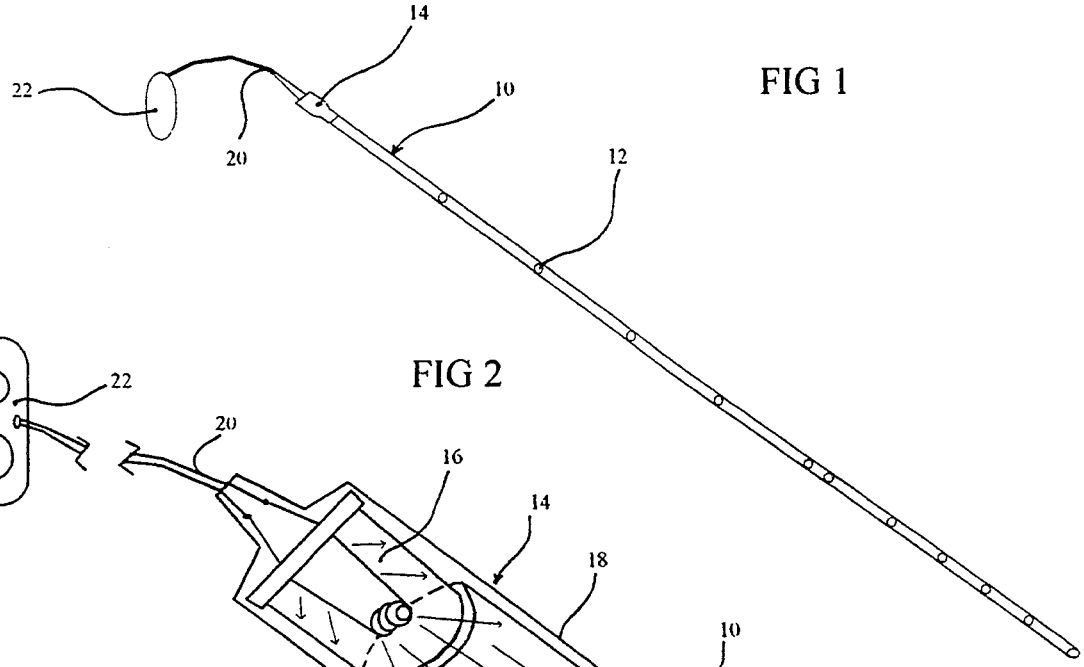
FIG. 1 is a perspective view of the fiber optic illuminator strand.

Referring now to FIG. 1, the present invention broadly comprises a single, solid, clear light conductive fiber optic strand 10, which exposes along its longitudinal length a plurality of predetermined proportionally etched abrasions 12. Aligned and seated to abut at one end of the fiber optic strand 10 is the light source emitter and associated wiring assembly, generally shown at 14, as depicted in FIGS. 1 and 2.

Figure 2:
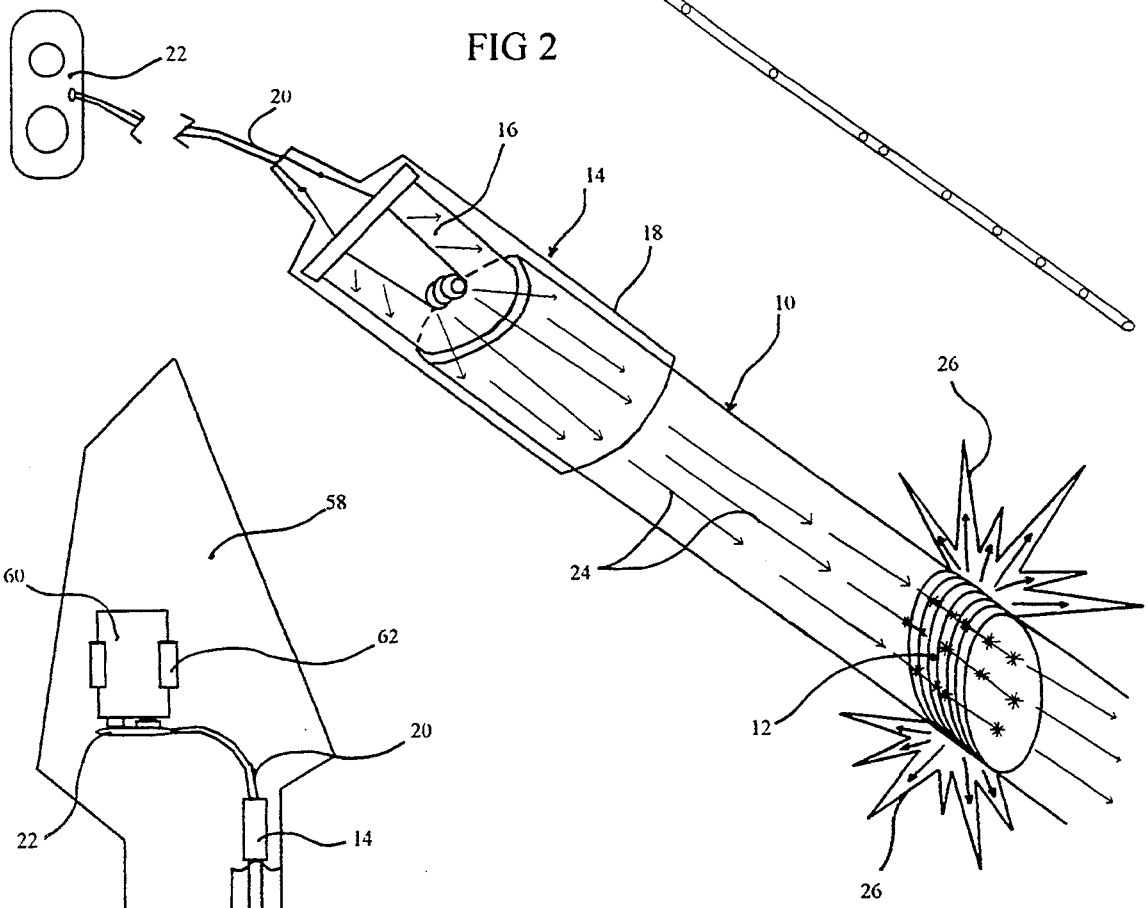
FIG. 2 is an exploded transparent view showing orientation of the internal structure and workings of the light source emitter and associated wiring assembly of FIG. 1.

Now referring to FIG. 2, an exploded transparent view of the internal workings of the light source emitter and associated wiring assembly 14 is depicted. The light emitter 14 consists of a miniature light bulb 16, which is housed within a thermally stable opaque sleeve 18. Stemming from the opposite end within the light emitter sleeve 18 are two wire leads 20 with a 9 volt battery snap 22 at one end that is electrically connected to the miniature light bulb 16 within the emitter sleeve 18. Light emitter 14 is aligned and seated to abut with the fiber optic strand 10 at one end within the emitter housing 18.

Figure 3:
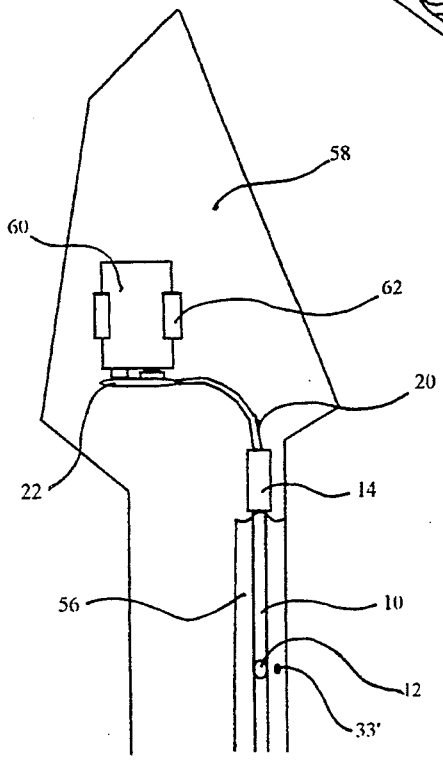
FIG. 3 is a rear view of the headstock of a guitar neck where the portable power source is located.

FIG. 3 illustrates a backside view of the headstock 58 of the guitar neck 30. Exposed behind the headstock 58 of the guitar neck 30 is the portable power supply 60, which is comprised of a 9 volt battery 60 that is held into position by an adhesively attached clip battery holder 62. Connecting and disconnecting the battery snap 22 to the battery 60 acts as a switch controlling the on/off condition of the light source 16.

When not in use, one of the connection snaps of the battery snap 22 is disconnected from the battery 60. Thus, the wire leads 20 are not left hanging to interfere with the guitarist when he or she is playing in the upper positions of the guitar neck 30. Alternatively, a clip may be provided on the back of the headstock 58 to prevent the wire leads 20 from hanging if both connection snaps of the battery snap 22 are disconnected from the battery 60. Furthermore, both connection snaps of the battery snap 22 can always be connected to the battery 60, if a small on/off switch is also provided to prevent the battery 60 from being prematurely drained.

As will be apparent to those of ordinary skill in the music art, most standard electric or acoustic guitars have six strings with various fret scale spacings and fretboard lengths. A guitar having six strings with varying fretboard scale lengths is not the only type of musical instrument for which the invention can be applied. An electric or acoustic 12-string guitar or 4-string bass can be substituted equally well without departing from the spirit or scope of the invention. Furthermore, the present invention can also be utilized with mandolins, banjos, sitars, violins as well as many other stringed instruments. The present invention may also be utilized with fretless stringed instruments and stringed instruments having no fret markers. A standard 6-string electric guitar neck is shown only as a presentation model for understanding the principle of application for the neck illuminator invention.

Figure 4:
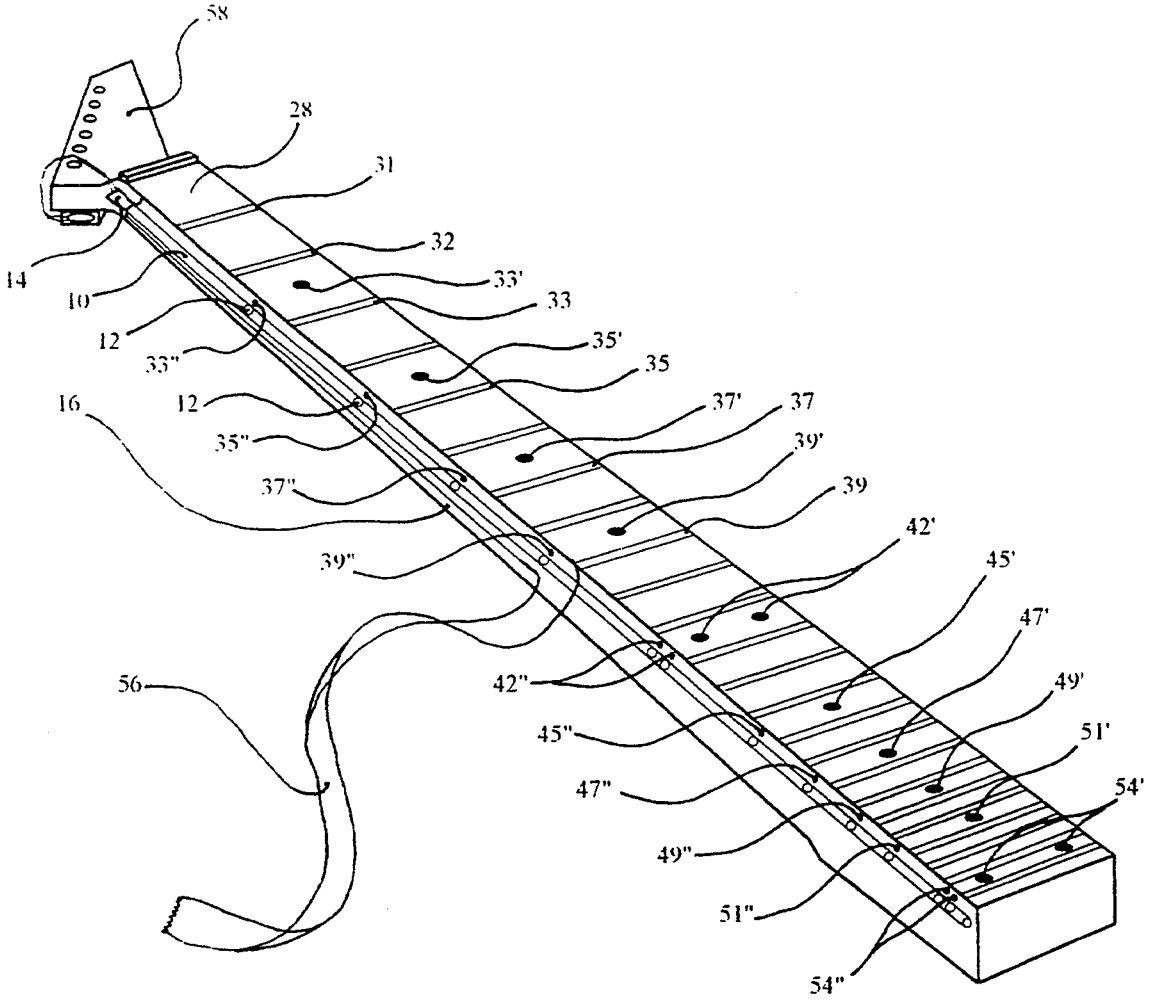
FIG. 4 is a perspective view of a guitar neck with the fiber optic illuminator strand exposed in position onto the top side surface of a guitar neck of FIGS. 1, 2, and 3.

Referring now to FIG. 4, set in the substantially flat surface 28 of the guitar neck 30 are a plurality of frets 31, 32, and 33 being representative thereof, transversely disposed at predetermined locations along its horizontal length. Disposed on the fretted surface 28 of the neck 30 between predetermined frets, are fret indicators or fret markers 33', 35', and 37' being representative thereof. These markers commonly appear adjacent the 3rd 33, 5th 35, 7th 37, 9th 39, 12th 42, 15th 45, 17th 47, 19th 49, 21st 51, and 24th 54 frets, and are intended to aid the guitarist in properly positioning their hand at the desired fret along the guitar neck 30. A double fret marker 42' usually appears adjacent the 12th fret 42 and the 24th fret 54, indicating the next higher octave. A similar set of fret markers, 33'', 35'', and 37'' being indicative thereof also appear on the top side surface 16 of the guitar neck 30 at locations corresponding to the markers on the fretted surface 28 as shown in FIG. 3. The top side surface 16 also contains a pair of double fret markers 42'' and 54'', indicating the locations of the 12th fret 42 and the 24th fret 54. For each etched abrasion 12 located on the fiber optic strand 10, there are coinciding fret markers 33'', 35'', and 37'' being representative thereof, located on the top side surface 16 of the guitar neck 30. The fiber optic strand 10 is externally applied on to the guitar neck 30 by aligning the proportionally etched abrasions 12 along the longitudinal length of the optic strand 10 with fret markers 33'', 35'', and 37'', etc. located along the horizontal length of the top side surface 16 of the guitar neck 30. Clear adhesive tape 56 is utilized to adhere the optic strand 10 to the top side surface 16 of the guitar neck 30, also establishing a protective quality to prevent the optic strand 10 from being dislocated or broken.

Referring to FIG. 2, as will be apparent to those of ordinary skill in the fiber optic art, when the light source 16 is on, the light 24 emitted therefrom fiber optically conducts and is evenly distributed throughout the entire length of the fiber optic strand 10. The conducting light 24 then refracts within, and disperses emittively 26 through the predetermined proportionally etched abrasions 12 giving the effect of multiple illuminated guitar fret marker lights along the horizontal length of the top side surface 16 of the guitar neck 30. This illuminated effect allows the guitar to be played in dark or dim surroundings by assisting the guitarist in locating the desired fret along the guitar neck 30.

In summary, an attachable and removable guitar neck illuminator accessory is disclosed which contains means for illuminating the fret markers on the top side surface of various guitar necks, allowing a guitar to be played in a dark or dim surrounding, and at the same time, adding to the aesthetic appeal of the guitar without significantly increasing its cost or physically altering its original condition.

The present invention may be utilized with stringed instruments not having a headstock portion attached to the top of the neck. With these instruments the tuning pegs are typically positioned at the bottom of the body of the instrument. With these instruments the battery can be disposed on the back side of the body and the light source positioned at the bottom of the neck while still providing all of the advantageous described above. Furthermore, there are instruments now being manufactured which have a neck portion and different fret positions along the neck but do not have any strings. These instruments operate by being sensitive to the touching of the neck with the fingers of the artist. Different positions along the neck of these instruments create different notes when touched. It is readily apparent the present invention can be utilized with such instrument as hand position in a dark surrounding is still a major concern of the artist.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An illuminated fret marker which is removeably attachable to an exterior surface of a guitar neck without causing any physical alteration or damage to the neck, the neck having a top side surface and a bottom side surface, said illuminated fret marker comprising:

a light source connected to one or more optically conductive fiber optic strands, substantially all of each strand extending along the exterior of substantially the entire length of the neck, and each strand defining along its longitudinal length at least one etched abrasion corresponding to at least one predetermined location on the top side surface of the neck to provide illuminated points on the neck.

* * * * *